US006244072B1

(12) United States Patent
Rathbone

(10) Patent No.: US 6,244,072 B1
(45) Date of Patent: Jun. 12, 2001

(54) AIR SEPARATION

(75) Inventor: Thomas Rathbone, Farnham (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/505,120

(22) Filed: Feb. 16, 2000

(30) Foreign Application Priority Data

Feb. 19, 1999 (GB) ..... 9903908

(51) Int. Cl.[7] ..... F25C 1/00
(52) U.S. Cl. ..... 62/646; 62/650
(58) Field of Search ..... 62/646, 650

(56) References Cited

U.S. PATENT DOCUMENTS

| | | | | |
|---|---|---|---|---|
| 3,590,917 | | 7/1971 | Leonard et al. . | |
| 4,072,023 | * | 2/1978 | Springmann | 62/650 |
| 5,341,647 | * | 8/1994 | Koeberle et al. | 62/650 |
| 5,664,438 | * | 9/1997 | Bonaquist et al. | 62/650 |
| 5,975,503 | | 11/1999 | Douglas . | |

FOREIGN PATENT DOCUMENTS

| | | |
|---|---|---|
| 0 7040119 | 10/1996 | (EP) . |
| 0 780 646 | 6/1997 | (EP) . |
| 0 797 065 | 9/1997 | (EP) . |
| 2 204 117 | 11/1998 | (GB) . |

* cited by examiner

*Primary Examiner*—Ronald Capossela
(74) *Attorney, Agent, or Firm*—Joshua L. Cohen; Salvatore P. Pace

(57) ABSTRACT

Air is separated in a double rectification column comprising a higher pressure column and a lower pressure column, the latter operating at pressures of less than 2 bar absolute. An oxygen product is withdrawn from the column by a pump. A first vaporous nitrogen stream is taken from the top of the higher pressure column, is compressed in a compressor and is used in a gas turbine. Feed to the lower pressure column is derived from a stream of the bottom oxygen-enriched liquid fraction obtained in the higher pressure column. To this end, this stream is subjected to further separation (typically in further rectification column) to form a vaporous nitrogen fraction (a flow of which is condensed and is used as reflux in the lower pressure column) and an oxygen-containing feed to the lower pressure column which flows via an outlet and a condenser to the column. At least 60% of the nitrogen product flowing to the gas turbine is taken from the higher pressure column.

16 Claims, 1 Drawing Sheet

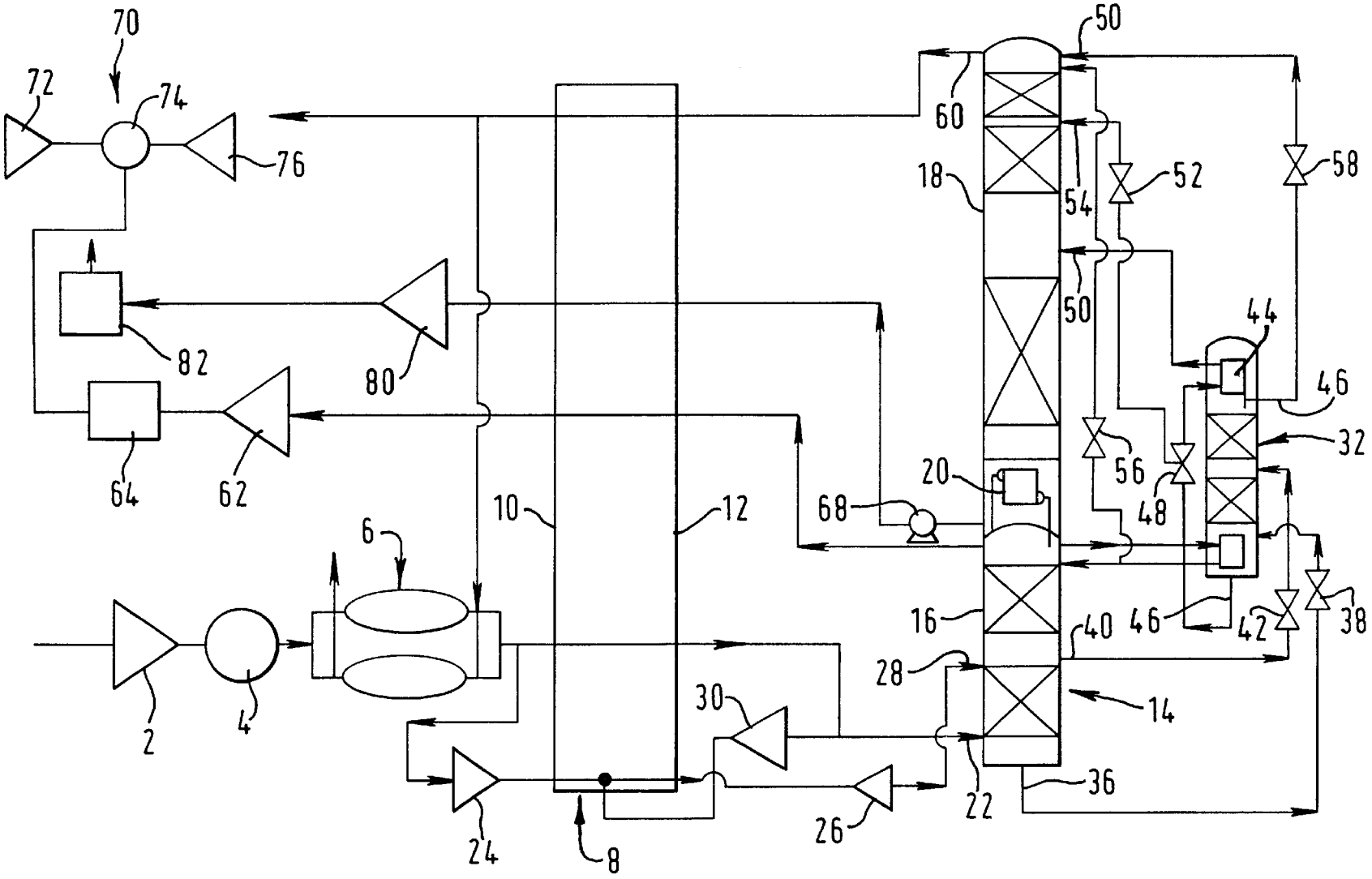
58
46
32
38
44
42
52
48
56
46
14
50
54
50
40
36
60
18
20
16
22
28
68
26
30
12
8
10
24
80
6
76
62
4
74
82
64
2
70
72

AIR SEPARATION

BACKGROUND OF THE INVENTION

This invention relates to a method of and plant for air separation. It is particularly concerned with such a method and plant in which the air is separated into an oxygen product and a nitrogen product, and part of the nitrogen product is supplied at an elevated pressure to a gas turbine.

GB-A-2028 991 relates to such a method and plant. A double rectification column is employed to separate the air. (A double rectification column has a higher pressure rectification column, a lower pressure rectification column and a condenser-reboiler placing an upper, usually a top, region of the higher pressure rectification column, in heat exchange relationship with a region, usually a bottom region, of the lower pressure rectification column.) The air is rectified in the higher pressure rectification column, to form an oxygen-enriched liquid fraction and a first vaporous nitrogen fraction. A stream of the oxygen-enriched liquid fraction is withdrawn from the higher pressure rectification column and is used to form a feed stream to the lower pressure rectification column so as to form an oxygen product fraction and a second vaporous nitrogen fraction. At least one stream of a nitrogen product is taken from the double rectification column. A part of the nitrogen product is raised in pressure and is introduced into a gas turbine comprising an air compressor, a combustion chamber which has a first inlet communicating with the air compressor and a second inlet communicating with a source of fuel, and an expander communicating with the combustion chamber for expanding the hot gaseous products of the combustion of the fuel. The nitrogen is introduced into the combustion chamber or the expander normally for the purpose of reducing emissions of oxides of nitrogen in the exhaust of the expander. The work done by the expander is typically used to generate electrical power.

Because the combustion chamber of the gas turbine normally operates at a high pressure, typically in the range of 10 to 20 bar, GB-A-2028991 discloses that downstream of being warmed to ambient temperature a stream of the second vaporous nitrogen fraction is compressed to the necessary high pressure upstream of its being introduced into the gas turbine. The nitrogen feed to the gas turbine is normally formed exclusively of the second vaporous nitrogen fraction, that is the nitrogen fraction separated in the lower pressure rectification column. In order to reduce the work that has to be done in compressing this nitrogen, GB-A-2 028 991 recommends operating the lower pressure rectification column not at its normal pressure in the range of 1 to 2 bar (absolute), but instead at a higher pressure typically in the range of 3 to 5 bar. Several disadvantages arise. First, the higher pressure rectification column now has to be operated at a pressure in the order of 8 to 12 bars rather than at a conventional pressure in the range of 5–6 bar. Therefore, more work needs to be performed in compressing the incoming air for separation, and more compression equipment is required, than when the higher pressure rectification column is operated at its conventional pressure. Second, increasing the operating pressures of the higher and lower pressure rectification columns reduces the volatility of nitrogen relative to oxygen. An increase in the number of distillation stages required to effect the separation results. Third, the amount of co-produced nitrogen at a pressure above atmospheric is fixed by the oxygen/nitrogen ratio in the feed air. It is very often the case that the amount of co-produced elevated pressure nitrogen is in excess of the requirements for control of $NO_x$ , emissions. There are therefore penalties in terms of thermodynamic efficiency to mixing all the nitrogen with the fuel gas.

It is an aim of the present invention to make it possible to provide a method and plant which make it possible to reduce these disadvantages, but not at the cost of significant additional work of compression of nitrogen compared with when the low pressure column is operated at the optimum pressure disclosed in GB-A-2 028 991 A.

SUMMARY OF THE INVENTION

According to the present invention there is provided a method of separating air into an oxygen product and a nitrogen product, wherein a part of the nitrogen product is supplied at an elevated pressure to a gas turbine, including the steps of introducing a first stream of air into the higher pressure rectification column of a double rectification column, rectifying the air therein to form an oxygen-enriched liquid fraction and a first vaporous nitrogen fraction, withdrawing a stream of the oxygen-enriched liquid fraction from the higher pressure rectification column and using the stream of the oxygen-enriched liquid fraction to form a feed stream to the lower pressure rectification column of the double rectification column, rectifying the said feed stream in the lower pressure rectification column so as to form an oxygen product fraction and a second vaporous nitrogen fraction, taking at least one stream of a nitrogen product from the double rectification column, and raising the pressure of the nitrogen product and introducing it into the gas turbine, wherein the stream of the oxygen-enriched liquid fraction is subjected upstream of the lower pressure rectification column to further separation so as to form an oxygen-containing fraction from which the said feed stream is taken and a third vaporous nitrogen fraction, a flow of the third vaporous nitrogen fraction is condensed and is used as reflux in the lower pressure rectification column, at least 60% by volume of that part of the nitrogen product that is introduced into the gas turbine is taken from the first nitrogen vapor fraction, and the lower pressure rectification column is operated at a pressure, at its top, of less than 2 bar absolute.

The invention also provides plant for the separation of air and the generation of power, including a double rectification column including a higher pressure rectification column and a lower pressure rectification column; a gas turbine having an inlet for product nitrogen communicating with the double rectification column for a stream of the oxygen-enriched liquid fraction so as to enable a feed stream to the lower pressure rectification column to be formed therefrom; an inlet to the lower pressure rectification column for the feed stream; a first outlet from the lower pressure rectification column for a first product nitrogen stream of a second vaporous nitrogen fraction separated in the lower pressure rectification column; and a second outlet from the lower pressure rectification column for a stream of an oxygen product fraction separated therein, wherein the plant additionally includes further separation means for forming a third vaporous nitrogen fraction and an oxygen-containing fraction from which the said feed stream is taken in operation of the plant, and a condenser having an inlet for a flow of the third vaporous nitrogen fraction and an outlet for nitrogen condensate communicating with the lower pressure rectification column, whereby in operation of the plant the nitrogen condensate provides reflux for the lower pressure rectification column, in that the communication between the gas turbine and the double rectification column is such that, in operation, at least 60% by volume of the nitrogen product flow from the double rectification column to the gas turbine is taken from the first vaporous nitrogen fraction and in that the lower pressure rectification column is arranged to be operated at a pressure at its top of less than two bar absolute.

Preferably at least 90% by volume of the part of the nitrogen product that is supplied to the gas turbine is taken from the first vaporous nitrogen fraction. More preferably all of that part of the nitrogen product is so taken. Thus, in this case, the communication between the gas turbine and the double rectification column is solely with that region of the higher pressure rectification column where the first vaporous nitrogen fraction is obtained in operation of the plant according to the invention.

By taking the nitrogen flow to the gas turbine mainly or exclusively from the first vaporous nitrogen fraction, the double rectification column may be operated at traditional pressures for air separation while still enabling the nitrogen feed to the gas turbine to be taken at an initial pressure typically in the range of 4.5 to 5 bar, that is a pressure in the optimum pressure range identified by GB-A-2 028 991, thus enabling the advantage of reduced work of compression of nitrogen to be obtained (the reduced work being in comparison to that which would be required were all the turbine nitrogen to be produced at a pressure in the order of one bar when using a double rectification column operating at traditional pressures.

Moreover, further separating the stream of the oxygen-enriched liquid fraction makes it possible to operate the air separation at high thermodynamic efficiency notwithstanding the loss to the gas turbine of nitrogen that would otherwise be condensed to form liquid nitrogen reflux for the lower pressure rectification column.

Examples of the invention in which all the turbine nitrogen is taken from the higher pressure rectification column are particularly advantageous because only a single nitrogen pressurization means is typically required. This results in relatively simple nitrogen compression equipment.

The method and plant according to the invention are particularly advantageous if most or all of the oxygen product (e.g. at least 75%) is to be supplied to a high pressure partial oxidation process. The size of the partial oxidation unit and the proportion of the oxygen product that is sent to the unit tend to dictate the requirement for oxygen from the double rectification column. We have found that for a standard size of partial oxidation unit, the plant according to the invention can meet its demands for oxygen products while typically supplying sufficient nitrogen to enable the requirements for NO x control of the gas turbine to be met provided that the nitrogen is moisturized upstream of its introduction into the gas turbine. Such moisturization may be effected using waste heat generated in, for example, the partial oxidation process, the compression of the air that is to be separated, or the compression of the nitrogen upstream of its introduction into the gas turbine. It is therefore preferred to saturate with moisture that part of the nitrogen product that is introduced into the gas turbine.

Preferably at least part and more preferably, all of the oxygen product fraction is withdrawn in liquid state from the lower pressure rectification column, is pumped to a higher pressure, and is warmed to a non-cryogenic temperature in heat exchange relationship with air to be separated, the liquid product thereby being vaporized (unless at a supercritical pressure). Taking the oxygen product in liquid state reduces the thermal load on reboiling means associated with the lower pressure rectification column.

Since in a double rectification column all the reboiling requirements are often met by nitrogen separated in the higher pressure rectification column, the production of a relatively high proportion of the total nitrogen product from the higher pressure rectification column is thereby reduced.

At least 80% and preferably all of the oxygen product is typically produced at a purity of less than 97%. Oxidation and gasification processes typically employ 95% pure oxygen. Preferably, even though such a large proportion of the oxygen product be required at a purity level of less than 97%, the lower pressure rectification column preferably has only one reboiler associated with it notwithstanding the general preference nowadays for so-called dual (or even triple) reboiler methods of air separation when an impure oxygen product is mainly or exclusively required. Single reboiler methods have the advantage over dual and triple reboiler methods of enabling a greater recovery of nitrogen product to be achieved.

Typically, in examples of the method according to the invention in which at least a part of the oxygen product is withdrawn in liquid state, is pressurised, and is warmed to a non-cryogenic temperature, a second stream of air to be separated is liquefied and is at least in part introduced into the higher pressure rectification column. Any other part or parts of the liquefied second air stream may be introduced into the lower pressure rectification column and/or any further rectification column employed to perform the said further separation of the oxygen-enriched liquid fraction.

This further separation is indeed preferably performed in a further rectification column having a reboiler associated therewith, the further rectification column preferably operating at pressures lower than those at which the higher pressure rectification column operates, but higher than those at which the lower pressure rectification operates.

The reboiler associated with the further rectification column is preferably heated by means of a stream taken from the first vaporous nitrogen fraction. Resulting condensed nitrogen is preferably used as reflux in one or both of the higher pressure and lower pressure rectification columns.

The third vaporous nitrogen fraction, which is preferably of essentially the same purity as the first and second vaporous nitrogen fractions, is preferably condensed by heat exchange with the said feed stream, the latter being at least partially vaporized thereby.

Although it is preferred to raise by compression at non-cryogenic temperature the pressure of that part of the nitrogen product that is sent to the gas turbine, it is within the scope of the invention to condense such part of the nitrogen product, and to pump it to a desired higher pressure upstream of warming it to a non-cryogenic temperature.

In order to generate refrigeration for the air separation method according to the invention, one or more turbo-expanders may be employed. In preferred examples of the method according to the invention a third stream of air to be separated is turbo-expanded with the performance of external work, and the resulting turbo-expanded third air stream is introduced into the higher pressure rectification column.

Preferably, none of the air for separation is taken from the gas turbine.

Conventional means may be used to pre-purify the air to be separated, that is to remove therefrom impurities that would freeze or solidify at the cryogenic temperatures which obtain in the air separation plant, and to cool the pre-purified air to a temperature or temperatures suitable for its separation by rectification.

Rectification columns for use in the method and plant according to the invention are typically each constituted by one or more vessels in which downflowing liquid is brought into intimate mass exchange relationship with ascending vapor. It is, however, within the scope of the invention to omit from the further column any means for effecting such intimate mass exchange.

BRIEF DESCRIPTION OF THE DRAWINGS

FIG. 1 is a schematic flow diagram of an integrated plant comprising an air separation plant, a gas turbine, and a partial oxidation unit.

The drawing is not to scale.

DETAILED DESCRIPTION OF THE INVENTION

Referring to FIG. 1, air is compressed in a compressor 2 to a chosen pressure typically in the range of 5 to 6 bar. The air is cooled in an after-cooler 4 (and/or in a direct contact water chiller (not shown)) so as to remove heat of compression therefrom. The resulting cooled, compressed air is pre-purified by pressure swing adsorption or temperature swing adsorption in a unit 6 so as to remove from the air water vapor, carbon dioxide and other impurities of relatively low purity which would otherwise freeze in cryogenic parts of the plant. The configuration and operation of such pre-purification units are well known in the art and need not be described further herein.

A first stream of the resulting purified, compressed, air flows through a main heat exchanger 8 from its warm end 10 to its cold end 12 and is thereby cooled to a cryogenic temperature suitable for its separation by rectification. The resulting cooled first stream of air is introduced through inlet 22 into the higher pressure rectification column 16 of a double rectification column 14. The double rectification column 14 also has a lower pressure rectification column 18. The top region of the higher pressure rectification column 16 is placed in (indirect) heat exchange relationship with the bottom region of the lower pressure rectification column 18 by means of a condenser reboiler 20. In operation, nitrogen separated in the higher pressure rectification column 16 is condensed in the condenser-reboiler and some of the liquid oxygen separated in the lower pressure rectification column is reboiled. A second stream of purified compressed air is further compressed in a booster-compressor 24 upstream of the warm end 10 of the main heat exchanger 8. Heat of compression is removed from the further compressed second stream of air in an aftercooler (not shown). The after-cooled second stream of air flows through the main heat exchanger 8 from its warm end 10 to its cold end 12. Downstream of the cold end 12 of the main heat exchanger 8, the second stream of compressed air passes through an expansion device 26 which may take the form of a valve or, as shown in the drawing, a turbo-expander. A stream of liquid air passes out of the expansion device 26 at the operating pressure of the higher pressure rectification column 16 and is introduced through an inlet 28 into an intermediate mass exchange region of the higher pressure rectification column 16.

A third stream of purified compressed air is withdrawn from the second stream of an intermediate region of the main heat exchanger 8 and is expanded with the performance of external work in a turbo-expander 30. The resulting turbo-expanded third stream is united with the first stream upstream of the inlet 22 to the higher pressure rectification column 16 but downstream of the cold end of the main heat exchanger 8.

The three streams of air are separated in the higher pressure rectification column 16 into a bottom oxygen-enriched liquid (air) fraction and a first, top, vaporous nitrogen fraction. One part of this nitrogen fraction flows into the condenser-reboiler 20 and is condensed. The resulting condensate is employed as reflux in the higher pressure column 16. Another part if the first vaporous nitrogen fraction flows into a reboiler 34 associated with a further rectification column 32 and is also condensed. The resulting condensate is employed partly as reflux in the higher pressure rectification column, and as will be described herein below, partly as reflux in the lower pressure rectification column 18. A third part of the first vaporous nitrogen fraction is taken as product as will also be described below.

A stream of the oxygen-enriched liquid fraction flows out of the bottom of the higher pressure rectification column 16 through an outlet 36, is reduced in pressure by passage through a throttling or expansion valve 38, and is introduced into a bottom region of the further rectification column 32. The pressure at the top of the rectification column 32 is higher than the pressure at the top of the lower pressure column 18 but lower than the pressure at the top of the higher pressure rectification column 16. The oxygen-enriched liquid is separated in the further rectification column 32 into a third, top, vaporous nitrogen fraction (the corresponding nitrogen fraction separated in the lower pressure rectification column 18 shall be called "the second, top, vaporous nitrogen fraction") and a bottom liquid fraction, typically further-enriched in oxygen. (Typically, also separated in the further rectification column 32 is a liquid air stream which is withdrawn through an intermediate outlet 40 of the higher pressure rectification column 16, is reduced in pressure, by passage through a throttling or expansion valve 42, and is introduced into the further rectification column 32 at an intermediate main exchange region thereof.)

A flow of the third vaporous nitrogen fraction is condensed in a condenser 44 at the head of the further rectification column. A stream of the further enriched bottom liquid fraction is withdrawn from the further rectification column 32 through an outlet 46 and constitutes a feed stream to the lower pressure rectification column 18; however, this feed stream is reduced in pressure by passage through a throttling or expansion valve 48 and is employed to provide the necessary cooling for the condenser 44. As a result the feed stream is at least partially vaporized. The resulting at least partially vaporized feed stream is introduced into the lower pressure rectification column 18 through an inlet 50 at an intermediate level thereof.

A part of the nitrogen condensed in the condenser 44 is employed as reflux in the further rectification column 32 and the remainder as reflux in the lower pressure rectification column 18.

A further feed stream to the lower pressure rectification column 18 is formed by withdrawing a liquid air stream from an intermediate mass exchange region of the further rectification column 32 and reducing its pressure by passage through a throttling or expansion valve 52. The further feed stream is introduced through an inlet 54 into another intermediate region of the lower rectification column 18, this region being above that served by the inlet 50.

The feed streams are separated in the lower pressure rectification column 18 into a bottom oxygen product fraction, which is typically in the order of 95% (by volume) pure, and a second, top, nitrogen vapor fraction. An upward flow of vapor through the lower pressure column 18 is provided by the condenser reboiler 20, and a downward flow of liquid nitrogen reflux is provided, as aforesaid, from the reboiler 34 and the condenser 44 associated with the further rectification column 32, the respective liquid nitrogen streams being appropriately reduced in pressure by respective throttling or expansion valves 56 and 58.

A first nitrogen product stream is withdrawn from the first vaporous nitrogen fraction through an outlet 60 and is warmed by passage through the main heat exchanger 8 from its cold end 12 to its warm end 10. Downstream of the warm end 10 the first nitrogen product stream is compressed in a nitrogen compressor 62 typically to a pressure in the range of 15 to 30 bar absolute, such pressure typically being a little higher than at which the combustion chamber 74 of a gas turbine 70 operates, the gas turbine 70 including an air compressor 72, and an expander 76 in addition to the combustion chamber 74. The compressed first nitrogen product is moisturized in a suitable unit 64 for this purpose and is introduced into the combustion chamber 74 or a passage through which hot combustion products generated in operation of the gas turbine 70 flow from the combustion chamber 74 to the expander 76.

The second vaporous nitrogen fraction is taken as a second nitrogen product and is passed through the main heat exchanger 8 from its cold end 12 to its warm end 10. A part of second nitrogen product is used for the purpose of regenerating adsorbent beds forming part of the pre-purification unit 6. Typically, the remainder of the nitrogen product is vented to the atmosphere.

The oxygen product is taken from the bottom oxygen fraction separated in the lower pressure rectification column 18 by a pump 68 which raises its pressure typically to in excess of 10 bar. The resulting pressurised liquid oxygen stream is warmed to a non-cryogenic temperature by passage through the main heat exchanger 8 from its cold end 12 to its warm end 10. The oxygen, if below its critical pressure vaporises in the man heat exchanger 8. There is typically substantial heat exchange between the vaporizing oxygen product and a liquefying second stream of compressed purified air in the main heat exchanger 8. Downstream of the warm end 10 of the main heat exchanger 8 the oxygen product is further compressed in an oxygen compressor 80 (which typically has an after-cooler (not shown) associated therewith for removing the heat of compression) and is sent to a partial oxidation reactor 82 for formation of a gaseous fuel stream therein.

In a typical example of the plant shown in the drawing, the pressure at the bottom of the higher pressure rectification column 16 is in the order of 5 bar; the pressure at the top of the lower pressure rectification column is in the order of 1.3 bar; the pressure at the top of further rectification column 32 is in the order of 3 bar; the outlet pressure of the pump 68 is in the order of 15 bar; and the outlet pressure of the further compressor is in the order of 80 bar absolute. Form 40 to 45% of the total nitrogen product is taken from the first vaporous nitrogen fraction, i.e. from the higher pressure rectification column 16. In this example the nitrogen product contains less than 0.1% by volume of oxygen impurity, and the oxygen product has a purity of 95% by volume.

Various changes and modifications can be made to the plant shown in the drawing. For example, upstream of its passage through the main heat exchanger 8 the second nitrogen product stream may be employed to sub-cool the liquid feed streams to the lower pressure rectification column 18.

The oxygen-enriched liquid stream withdrawn from the higher pressure rectification column 16 is typically sub-cooled by indirect heat exchange countercurrent to the nitrogen product gas upstream of being allowed to flash into further rectification column 32 through the valve 38.

Further, if desired, not all of the second compressed end purified air stream need be introduced by the expander 26 into the higher pressure rectification column 16. Some of the stream may flow directly to the lower pressure column 18, and another part directly to the further rectification column 32. This avoids having intermediate outlets from the higher pressure rectification column 16 and the further rectification column 32.

While the invention has been described with reference to preferred embodiment, as will occur to those skilled in the art, numerous changes, additions and omissions can be made without departing from the spirit and scope of the present invention.

What is claimed is:

1. A method of separating air into an oxygen product and a nitrogen product using a double rectification column having a higher pressure rectification column and a lower pressure rectification column, wherein a part of the nitrogen product is supplied at an elevated pressure to a gas turbine, comprising the steps of:

introducing a first stream of air into the higher pressure rectification column of the double rectification column;

rectifying the air therein to form an oxygen-enriched liquid fraction and a first vaporous nitrogen fraction;

withdrawing a stream of the oxygen-enriched liquid fraction from the higher pressure rectification column and using the stream of the oxygen-enriched liquid fraction to form a feed stream to the lower pressure rectification column of the double rectification column;

rectifying the said feed stream in the lower pressure rectification column so as to form an oxygen product fraction and a second vaporous nitrogen fraction;

taking at least one stream of a nitrogen product from the double rectification column;

raising the pressure of the nitrogen product; and, introducing it into the gas turbine, wherein the stream of the oxygen-enriched liquid fraction is subjected upstream of the lower pressure rectification column to further separation so as to form an oxygen-containing fraction from which the said feed stream is taken and a third vaporous nitrogen fraction, a flow of the third vaporous nitrogen fraction is condensed and is used as reflux in the lower pressure rectification column, at least 60% by volume of that part of the nitrogen product that is introduced into the gas turbine is taken from the first nitrogen vapor fraction, and the lower pressure rectification column is operated at a pressure, at its top, of less than 2 bar absolute.

2. The method according to claim 1 wherein at least 90% by volume of the part of the nitrogen product that is supplied to the gas turbine is taken from the first vaporous nitrogen fraction.

3. The method according to claim 1 in which part or all of the oxygen product fraction is withdrawn in liquid state from the lower pressure rectification column, is pumped to a higher pressure, and is warmed to a non-cryogenic temperature in heat exchange relationship with air to be separated; and a second stream of air is liquefied and is introduced at least in part into the higher pressure rectification column.

4. The method according to claim 1 in which at least 80% of the oxygen product is produced at a purity level of less than 97%, and the lower pressure rectification column has associated therewith only a single reboiler.

5. The method according to claim 1 in which a third stream of air to be separated is turbo-expanded with the performance of external work and is introduced into the higher pressure rectification column.

6. The method according to claim 1 in which the further separation is performed in a further rectification column having a reboiler associated therewith, the further rectification column operating at pressures lower than those at which the higher pressure rectification column operates but higher than that at which the lower pressure rectification column operates.

7. The method according to claim 6 in which the reboiler associated with the further rectification column is heated by means of a stream taken from the first vaporous nitrogen fraction, and resulting condensed nitrogen is used as reflux in one or both of the higher pressure and lower pressure rectification columns.

8. The method according to claim 1 in which the third vaporous nitrogen fraction is condensed by heat exchange with the said feed stream and the said feed stream is at least partially vaporized thereby.

9. An apparatus for the separation of air and the generation of power comprising:

a double rectification column having a higher pressure rectification column and a lower pressure rectification column;

a gas turbine having an inlet for product nitrogen communicating with the double rectification column via nitrogen pressurization means;

an inlet to the higher pressure rectification column for a first stream of air to be separated therein into an oxygen-enriched liquid fraction and a first vaporous nitrogen fraction;

an outlet from the higher pressure rectification column for a stream of the oxygen-enriched liquid fraction so as to enable a feed stream to the lower pressure rectification column to be formed therefrom;

an inlet to the lower pressure rectification column for the feed stream; a first outlet from the lower pressure rectification column for a first product nitrogen stream of a second vaporous nitrogen fraction separated in the lower pressure rectification column;

a second outlet from the lower pressure rectification column for a stream of an oxygen product fraction separated therein;

a further separation means for forming a third vaporous nitrogen fraction and an oxygen-containing fraction from which the said feed stream is taken in operation of the plant; and, a condenser having an inlet for a flow of the third vaporous nitrogen fraction and an outlet for nitrogen condensate communicating with the lower pressure rectification column, whereby in operation of the plant the nitrogen condensate provides reflux for the lower pressure rectification column, in that the communication between the gas turbine and the double rectification is such that, in operation, at least 60% by volume of the nitrogen product flow from the double rectification column to the gas turbine is taken from the first vaporous nitrogen fraction, and in that the lower pressure rectification column is arranged to be operated at a pressure at its top of less than two bar absolute.

10. The apparatus according to claim 9 wherein the communication between the gas turbine and the double rectification column is solely with that region of the high pressure rectification column where the first vaporous nitrogen fraction is, in operation, obtained.

11. The apparatus according to claim 9 further comprising:

at least one pump for withdrawing part or all of the oxygen product fraction in liquid state from the lower pressure rectification column and for raising the liquid to a higher pressure;

means for warming the pressurised liquid to a non-cryogenic temperature; and, means for introducing, at least in part, a second liquefied stream of air into the higher pressure rectification column.

12. The apparatus according to claim 9 wherein the lower pressure rectification column has only a single reboiler associated therewith.

13. The apparatus according to of claim 9 further comprising a turbo-expander for introducing a third stream of air to be separated into the higher pressure rectification column.

14. The apparatus according to claim 9 wherein the further separation means is a further rectification column having a reboiler associated therewith.

15. The apparatus according to claim 14 in which the reboiler associated with the further rectification column is arranged to be heated by a stream of the first vaporous nitrogen fraction.

16. The apparatus according to claim 9 wherein the condenser is arranged to be heated by the said feed stream.

* * * * *